US005632492A

United States Patent [19]

Lehmann et al.

[11] Patent Number: 5,632,492

[45] Date of Patent: May 27, 1997

[54] SEALING CONFIGURATION FOR A PASSAGE OF A SHAFT THROUGH A CASING AND METHOD OF OPERATING THE SEALING CONFIGURATION

[75] Inventors: Wolfgang Lehmann; Detlef Friebe, both of Görlitz, Germany

[73] Assignee: Siemens Aktiengesellschaft, Munich, Germany

[21] Appl. No.: 549,057

[22] Filed: Oct. 27, 1995

[30] Foreign Application Priority Data

Apr. 27, 1993 [DE] Germany ..... 43 13 805.5

[51] Int. Cl.[6] ..... F16T 15/16

[52] U.S. Cl. ..... 277/1; 277/15; 277/29; 415/112; 415/168.2

[58] Field of Search ..... 277/1, 2, 3, 15, 277/17, 18, 29, 53; 415/112, 168.2, 168.4, 230

[56] References Cited

U.S. PATENT DOCUMENTS

| | | | |
|---|---|---|---|
| 3,503,618 | 3/1970 | Real . | |
| 4,044,561 | 8/1977 | Hohn | 277/15 |
| 4,193,603 | 3/1980 | Sood . | |
| 5,454,689 | 10/1995 | Falarigna | 277/53 |

FOREIGN PATENT DOCUMENTS

| | | |
|---|---|---|
| 0 463 532 | 1/1992 | European Pat. Off. . |
| 451 680 | 11/1927 | Germany . |
| 576 969 | 5/1933 | Germany . |
| 1 109 722 | 6/1961 | Germany . |
| 28 41 631 | 3/1980 | Germany . |
| 33 33 530 | 4/1984 | Germany . |
| 37 19 861 | 2/1988 | Germany . |
| 382 779 | 12/1964 | Switzerland . |
| 158880 | 10/1921 | United Kingdom . |
| 618 133 | 3/1949 | United Kingdom . |
| 838 092 | 6/1960 | United Kingdom . |
| 872 646 | 7/1961 | United Kingdom . |
| 1 267 548 | 3/1972 | United Kingdom . |
| 26 434 84 | 1/1978 | United Kingdom . |

OTHER PUBLICATIONS

"Thermische Turbomaschinen" Publ. by W. Trauper, Berlin 1977, vol. 1, Chapter 10, pp. 555–575.

*Primary Examiner*—Daniel G. DePumpo
*Attorney, Agent, or Firm*—Herbert L. Lerner; Laurence A. Greenberg

[57] ABSTRACT

A sealing configuration for a passage through a stationary casing having a shaft leading through the passage and an inner space being enclosed by the stationary casing for receiving a fluid and from which the shaft emerges, includes at least one vapor chamber surrounding the shaft, having two sides and being open to the surroundings. Seals are disposed adjacent the vapor chamber on both of the sides along an axis of the shaft for admitting the fluid to the vapor chamber through at least one of the seals. A suction device is connected to the vapor chamber. A method for operating the sealing configuration includes extracting the fluid from the vapor chamber with the suction device, except for a residual quantity of the fluid being led away to the surroundings.

16 Claims, 1 Drawing Sheet

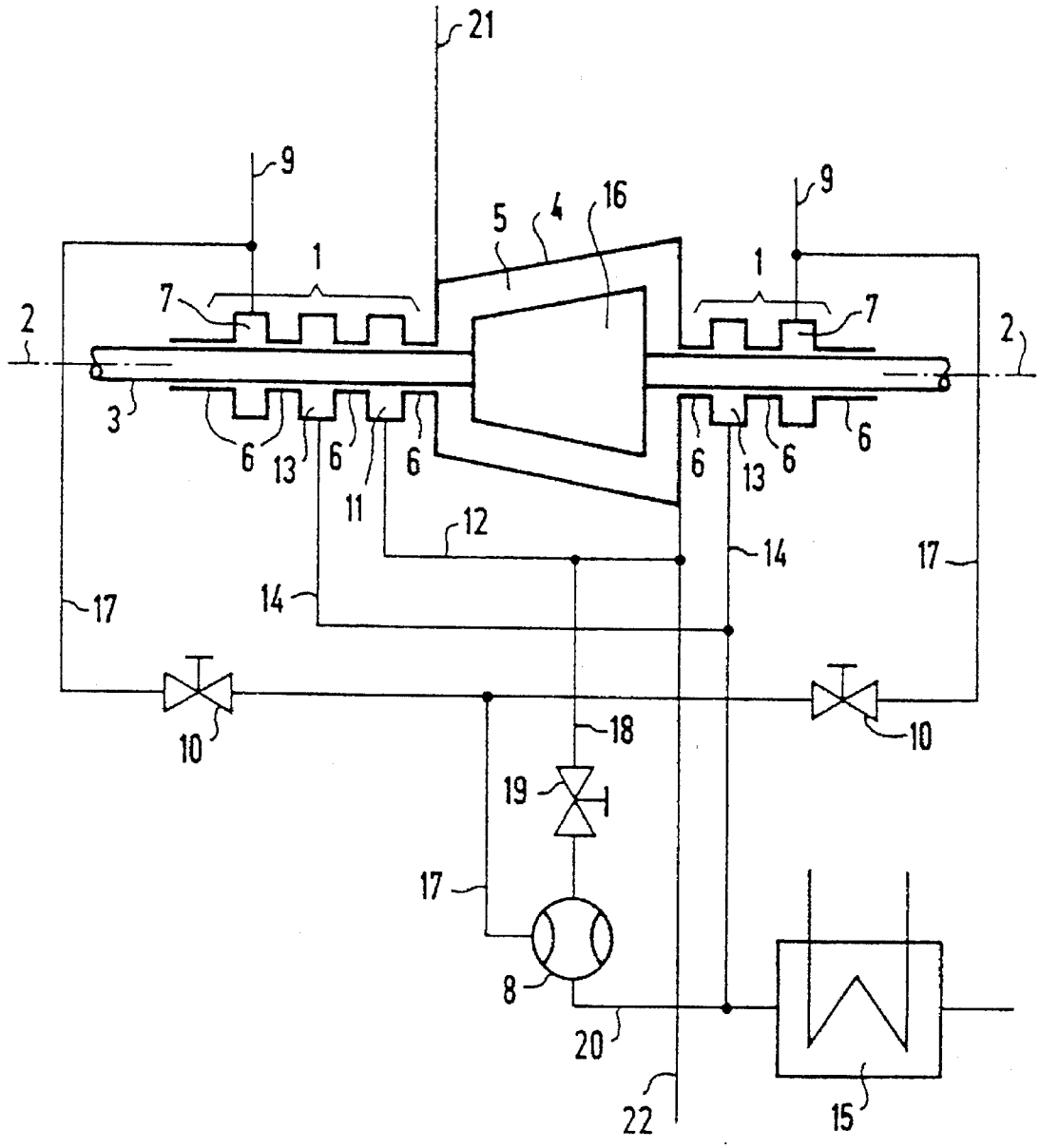
21
9
9
5
4
16
1
1
7
7
2
2
3
6
13
6
11
6
6
13
6
6
12
14
14
17
17
10
10
18
19
17
8
20
22
15

SEALING CONFIGURATION FOR A PASSAGE OF A SHAFT THROUGH A CASING AND METHOD OF OPERATING THE SEALING CONFIGURATION

CROSS-REFERENCE TO RELATED APPLICATION

This application is a continuation of International Application Serial No. PCT/DE94/00421, filed Apr. 15, 1994 and published as WO94/25738 Nov. 10, 1994.

BACKGROUND OF THE INVENTION

1. Field of the Invention

The invention relates to a sealing configuration for a passage of a shaft having an axis through a stationary casing enclosing an inner space to which a fluid can be admitted and from which the shaft emerges, the sealing configuration having a vapor chamber surrounding the shaft and being open to the surroundings, and having seals adjacent the vapor chamber on both sides along the axis for admitting the fluid to the vapor chamber through at least one of the seals. The invention also relates to a method for operating such a sealing configuration.

Such a sealing configuration and a method for its operation are disclosed in German Patent DE-PS 576 969.

The invention particularly relates to a sealing configuration for application to a steam turbine in order to seal a passage for a rotating shaft from a casing of the steam turbine. In it, steam which emerges along the shaft from the housing through a seal is collected in a vapor chamber and released into the surroundings. Due to condensation, the steam is converted into a mist and is therefore visible at the sealing configuration as a "vapor image". It thus offers a simple functional check for the sealing configuration. Such a simple functional check is particularly interesting and desirable, in many cases, on a steam turbine for industrial purposes having a power output which is generally between approximately 1 MW and approximately 50 MW. In such a steam turbine, the pollution of the surroundings due to a vapor image is generally within acceptable limits.

Sealing configurations for passages or ducts for shafts are known in many forms in the prior art. In particular, there is a large number of embodiment possibilities for the individual components of the sealing configurations, in particular the seals themselves. Sealing configurations for use on steam turbines appear in German Published, Non-Prosecuted Patent Applications DE 26 43 484 A1 and DE 33 33 530 A1. Various embodiment possibilities for components of the sealing configurations are also described in those publications. Published European Patent Application 0 463 532 A1 concerns the removal of steam which emerges from a sealing configuration, with that steam being condensed in a so-called "vapor condenser configuration". The main feature in that publication is the configuration of the vapor condenser itself. In other words, in particular, it is constructed as an unpressurized heat exchanger, which means that the condensation of the vapor in it takes place at approximately normal atmospheric pressure. No release of vapor into the surroundings takes place since the vapor is completely condensed.

British Patent Specification 1 267 548 likewise concerns a sealing configuration on a steam turbine of the type which is described in Published European Patent Application 0 463 532 A1. That sealing configuration is to be usable not only on a passage for a rotating shaft, in particular a driven shaft of a steam turbine, but also on a passage for a valve spindle which can be displaced along its axis and is not necessarily rotatable. In that sense, the concept of a "shaft" is to be understood herein in such a way that it includes both rotatable shafts and displaceable spindles.

The function and structure of seals for sealing configurations of the type described are disclosed in the book entitled "Thermische Turbomaschinen" [Thermal Turbomachines] by W. Traupel, Springer-Verlag, Berlin 1977, Volume 1, Chapter 10. In particular, seals of the labyrinth seal type are described in detail. Other seals, namely stuffing box seals, in particular stuffing box seals with carbon rings, are only mentioned in passing and are designated as being disadvantageous for steam turbines in power stations. That comment, however, naturally does not refer to the use of stuffing boxes and/or carbon rings in seals for steam turbines which are intended for industrial purposes. It is seen from German Published, Non-Prosecuted Patent Applications DE 26 43 484 A1 and DE 33 33 530 A1 that carbon ring seals are demonstrably very common in such steam turbines.

A sealing configuration of the type mentioned at the outset, along with a method for executing it, is disclosed in German Patent DE-PS 567 969. In connection with the device described therein, it has been additionally provided to charge several vapor chambers in various sealing configurations with a fluid, namely steam, from a single source. That device is intended to provide relief of the environment from vapor chamber steam, since in order to assure sufficient overpressure in each vapor chamber it is only necessary that fluid flow from a single scaling configuration, namely the sealing configuration in which the fluid encounters the least resistance between the vapor chamber and the flue through which the fluid is exhausted.

German Patent DE-PS 451 680 relates to a differently constructed sealing configuration. In that sealing configuration a vacuum is maintained in a chamber surrounding the shaft, which is located farthest away from the shaft along it and which vacuum causes air to be sucked along the shaft into the chamber. That is intended to assure that no steam at all reaches the environment. The vacuum is produced by an appropriately provided aspirating device, which moves the mixture of air and steam formed in the chamber away into a flue or into a recovery installation.

As was already stated, some pollution of the surroundings with vapor always appears at a sealing configuration of the type described at the outset and that pollution can, under certain circumstances, make special configurations necessary for keeping the air pure. In addition, a functional check using a vapor image can only have limited reliability because it is not easy to recognize small changes. The functional check must, therefore, essentially be limited to determining whether or not damage to a sealing configuration has already occurred. Regular diagnosis of the shaft sealing configuration, with the objective of obtaining a quantitative conclusion on the functional capability of the sealing configuration and of recognizing damage even in its incipient stage, is impossible in the prior art.

SUMMARY OF THE INVENTION

It is accordingly an object of the invention to provide a sealing configuration for a passage of a shaft through a casing and a method of operating the sealing configuration, which overcome the hereinafore-mentioned disadvantages of the heretofore-known devices and methods of this general type and which permit both a limitation to pollution of the surroundings and a reliable diagnosis, i.e. in particular a reliable determination, that damage is starting.

With the foregoing and other objects in view there is provided, in accordance with the invention, in an assembly having a stationary casing, a passage for the stationary casing, a shaft leading through the passage and having an axis, and an inner space being enclosed by the stationary casing for receiving a fluid and from which the shaft emerges, a sealing configuration for the passage, comprising a vapor chamber surrounding the shaft, having two sides and being open to the surroundings; seals disposed adjacent the vapor chamber on both of the sides along the axis for admitting the fluid to the vapor chamber through at least one of the seals; and a suction device connected to the vapor chamber.

The suction device makes it possible to extract part of the fluid from the vapor chamber and therefore to achieve a reduction in the pollution of the surroundings. Furthermore, suitable construction and setting of the suction device makes it possible to achieve the result of ensuring that a well-defined, substantially constant proportion of the total fluid delivered to the vapor chamber is extracted so that fluctuations in the delivery of the fluid through the seal only act on the residual quantity released into the surroundings. In consequence, small fluctuations in the flow of fluid to the vapor chamber can cause large fluctuations in the outflow of the fluid into the surroundings. Those fluctuations can be detected without difficulty and in the simplest way, in particular just by observation. This permits a sensitive check on the flow of fluid to the vapor chamber and therefore a sensitive check on the sealing effect of the sealing configuration. Particular preference is given to the vapor chamber being connected to the surroundings through the use of a vapor pipe and the suction device being connected onto the vapor pipe. In this way, the reaction effect of the suction device onto a flow of fluid in the seals and in the vapor chamber is kept small and the mode of operation of the sealing configuration is improved.

In accordance with another feature of the invention, an injector type of jet pump, in which the fluid that is admitted to the casing is used as the driving medium and is preferably supplied from the inner space of the casing, is of particular interest as the suction device. The sealing configuration that is improved in such a way operates substantially independently of the casing and the device located within the casing, and this substantially supports its operational reliability.

In accordance with a further feature of the invention, there is provided a control valve for setting the suction effect, being connected upstream of the suction device to permit sensitive setting of the flow equilibrium produced by the suction device.

In accordance with an added feature of the invention, there is provided, in the sealing configuration, between the vapor chamber and the inner space, a blocking chamber which surrounds the shaft, which has seals adjacent to it on both sides along the axis and to which fluid can be delivered through the use of an associated inlet conduit. Within the present framework, such a blocking chamber can satisfy a plurality of functions. It can be used to provide defined thermodynamic relationships, in particular a defined pressure, before the vapor chamber, independently of the relationships in the inner space, in order to ensure that the admission to the seal leading to the vapor chamber is substantially independent of the operation. In addition, and if necessary additionally, it is possible to ensure that penetration of air into the inner space is prevented by correspondingly setting the pressure in the blocking chamber. A corresponding positive pressure has to be set in the blocking chamber for this purpose.

In accordance with an additional feature of the invention, the inlet conduit associated with the blocking chamber is advantageously connected to the inner space, in particular to a region of the inner space in which a pressure is present that is suitable for the blocking chamber. It should be noted that a pressure drop is always present in the inner space of the casing of an operating steam turbine due to the expansion of the steam along the turbine. Connection of the inlet conduit to the inlet, the outlet or a tap on the steam turbine is possible, in order to correspond with the particular specification.

In accordance with yet another feature of the invention, there is provided, in particular in association with a blocking chamber as just described, a leakage chamber between the vapor chamber and the inner space, which leakage chamber surrounds the shaft, has seals adjacent to it on both sides along the axis and from which fluid can be led away through the use of an associated outlet conduit.

In accordance with yet a further feature of the invention, the outlet conduit can be connected to a leakage condenser in which the fluid that has been led away is condensed. This leakage condenser is preferably constructed for the condensation of the fluid at a pressure which corresponds approximately to normal atmospheric pressure. The leakage chamber can be employed to form a defined pressure drop along the sealing configuration because a specified pressure corresponding to the requirements is maintained in the leakage chamber. Furthermore, the flow of fluid which reaches the vapor chamber can be influenced by setting the pressure in the leakage chamber. This is of particular importance where the sealing configuration has a very high pressure admitted to it from the inner space of the casing. This can, for example, be the case in the region of the inlet flow of a steam turbine.

In accordance with yet an added feature of the invention, the sealing configuration is constructed for the simultaneous sealing of two passages, with each passage having a vapor chamber connected to the suction device. In this way, a particularly good sealing effect can be ensured at each passage by a simple device.

In accordance with yet an additional feature of the invention, there are provided control valves each being respectively located between a vapor chamber and the suction device in order to permit an individual setting of the suction effect for each vapor chamber. In this way, it is possible to compensate, in particular, for differences in the admission to the passages from the inner space. It is also possible to compensate for certain functional differences due to manufacturing reasons. Compensation is preferably provided for large functional differences through the use of corresponding blocking and/or leakage chambers.

With the objects of the invention in view, there is also provided a method for operating a sealing configuration for a passage of a shaft with an axis through a stationary casing enclosing an inner space to which a fluid is admitted and from which the shaft emerges, the sealing configuration including a vapor chamber being open to the surroundings, surrounding the shaft and having two sides, seals being adjacent the vapor chamber on both of the sides along the axis for admitting the fluid to the vapor chamber through at least one of the seals, and a suction device connected to the vapor chamber, and the method comprising extracting the fluid from the vapor chamber with the suction device, except for a residual quantity of the fluid being led away to the surroundings.

The operation of the sealing configuration of each apparatus is therefore provided in such a way that the casing has fluid admitted to it and the fluid flow to the vapor chamber through at least one of the seals, takes place, according to the invention, in such a way that the fluid is extracted from the vapor chamber with the exception of a residual quantity which is led away into the surroundings. It is then useful for a specified constant proportion of the total fluid which has flowed into the vapor chamber to be extracted, so that the fluctuations in the flow of fluid admitted to the vapor chamber are imparted mainly to the residual quantity released into the surroundings and therefore to the vapor image. This residual quantity, which can fluctuate greatly in the case of changes to the sealing configuration, is accessible to simple inspection measures and offers an outstanding possibility for a functional check. Its quantity is also limited so that, at most, it only pollutes the surroundings to a slight extent.

In accordance with another mode of the invention, the sealing configuration of each apparatus is particularly useful for application in a case where the fluid is a vapor, preferably water vapor. Where the fluid is water vapor, in particular, the residual quantity emerging from the sealing configuration makes itself noticeable as a cloud of mist, which is designated as a "vapor image". This is directly accessible to visual monitoring and a change in the size of the mist cloud is a direct indication of a change within the sealing configuration that is possibly disadvantageous.

In accordance with a concomitant mode of the invention, the application of the sealing configuration of each apparatus is particularly important in a steam turbine which is enclosed by the casing and puts the shaft into rotation. Particularly on a steam turbine for an industrial purpose, in which the shaft often reaches a very high rotational frequency, the monitoring of the correspondingly highly loaded sealing configuration is of great importance. In this connection, it is also of great importance that the sealing configuration according to the invention has very low requirements with respect to the apparatus and, in particular, requires no complicated apparatus for diagnostic purposes. In consequence, the invention is very suitable in association with steam turbines for industrial purposes involving the usual cost considerations.

Other features which are considered as characteristic for the invention are set forth in the appended claims.

Although the invention is illustrated and described herein as embodied in a sealing configuration for a passage of a shaft through a casing and a method of operating the sealing configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a diagrammatic and schematic circuit diagram of an embodiment of the invention.

DESCRIPTION OF THE PREFERRED EMBODIMENTS

Referring now to the single FIGURE of the drawing in detail, there is seen a diagrammatic and schematic representation of a steam turbine 16 which is located in an inner space or chamber 5 of a casing or housing 4. Steam is fed to the steam turbine 16 through a steam inlet conduit 21 and steam which is expanded in the steam turbine 16 is led away through a steam outlet conduit 22. Due to the expansion of the steam, the steam turbine 16 puts a shaft 3 into rotation about its axis 2. The shaft 3 is led out of the casing 4 at two passages or ducts 1. Common reference will be made to both passages 1 in order to explain certain features. Included in each passage 1 is a vapor or leakage steam chamber 7 which surrounds the shaft 3 and has two seals 6 adjacent to it along the axis 2. Steam flows along the shaft 3 to this vapor chamber 7 and is led away by a respective vapor or leakage steam pipe 9. From the vapor pipe 9, the steam reaches the surroundings where it condenses and becomes visible as a mist, which is a so-called "vapor image". Connected to each vapor pipe 9, is a suction pipe 17 which leads to a suction device 8, namely an injector or jet pump. Part of the steam is extracted from the vapor pipe 9 by the suction device. In addition to reducing the pollution of the surroundings, this forms a very sensitive indicator for the condition of the passage 1 because even a small fluctuation in the flow of steam to the vapor chamber 7 becomes directly visible as a noticeable change in the size of the vapor image. In consequence, a functional disturbance of the seals 6 can be recognized in good time, possibly before it develops into real damage. A control valve 10 is included in each suction conduit 17 so that the proportion of steam extracted from the vapor pipe 9 can be sensitively regulated. As a simplification, it is possible to replace the control valve 10 by a throttle with a fixed setting, for example an orifice, particularly in the case where the requirements placed on the sealing configuration and the ability to monitor it are not too great.

A leakage chamber 13, which likewise surrounds the shaft 3 and which has seals adjacent to it along the shaft, is integrated in the passage 1 between each vapor chamber 7 and the inner or internal space 5. Part of the steam which passes through the seals 6 along the shaft 3 and into the leakage chamber 13 is led away through an associated outlet conduit 14 and fed to a leakage condenser 15. The steam pressure in the leakage chamber 13 can be fixed by selecting the steam pressure in the leakage condenser 15. This, in particular, makes it possible to set the flow to the vapor chamber 7. Leakage chambers 13 and the leakage condenser 15 are not always necessary. In particular, it is possible to dispense with a leakage condenser 15 if the steam pressure in the casing remains relatively low. Steam would then, if necessary, have to be extracted from an optionally present leakage chamber 13 through the steam outlet conduit 22.

The left-hand passage 1 is connected onto the casing 4 near the steam inlet conduit 21 so that this passage 1 has steam at very high pressure admitted to it from the inner space or chamber 5. In order to provide at least partial compensation for this pressure, a blocking chamber 11 surrounding the shaft 3 is provided, starting from the inner or internal space 5, behind one of the seals 6. This blocking chamber 11 is connected through the use of an inlet conduit 12 to the steam outlet conduit 22 and therefore to a region in the inner space 5 which is at a relatively low pressure. This reduces the load on the further components of the left-hand passage 1, namely the leakage chamber 13 and the vapor chamber 7 and at least partially balances it with the load on the components of the right-hand passage 1, which is connected onto the casing 4 near the steam outlet conduit 22 and has correspondingly substantially smaller loads. For this reason, there is no blocking chamber provided at the right-hand passage 1.

The injector or jet pump 8, which extracts steam from the vapor pipe 9 through the use of the suction conduits 17, is operated with steam which is taken from the inner space 5 through a part of the steam outlet conduit 22 and the inlet conduit 12. In the example represented, this is provided under the assumption that the steam turbine 16 is a so-called backpressure turbine from which the steam is released at a relatively high pressure. Such back-pressure steam turbines are frequently employed in industry. If, in another case, the pressure in the steam outlet conduit 22 is not high enough, which depends on the construction of the steam turbine 16, steam for the injector or jet pump 8 can be taken from another location, in particular from the inlet of or from a tap on the steam turbine 16. The steam used as the driving medium passes through a driving medium conduit 18 and a control valve 19 to the injector or jet pump 8 where it takes up the steam extracted from the vapor pipes 9 and from where it is led away through an outlet conduit 20. In the case represented, this outlet conduit leads to the leakage condenser 15.

The sealing configuration described above permits a simple functional check on a passage for a shaft and, in addition, permits a marked reduction in the pollution of the surroundings. It is particularly suitable for use on a steam turbine and particularly on a steam turbine for an industrial purpose with a power output between approximately 1 MW and 40 MW.

We claim:

1. In an assembly having a stationary casing, a passage for the stationary casing, a shaft leading through the passage and having an axis, and an inner space being enclosed by the stationary casing for receiving a fluid and from which the shaft emerges, a sealing configuration for the passage, comprising:

a vapor chamber surrounding the shaft, having two sides and being open to the surroundings;

seals disposed adjacent said vapor chamber on both of said sides along the axis for admitting the fluid to said vapor chamber through at least one of said seals; and a suction device connected to said vapor chamber.

2. The sealing configuration according to claim 1, including a vapor pipe connecting said vapor chamber to the surroundings, said suction device being connected to said vapor pipe.

3. The sealing configuration according to claim 1, wherein said suction device is a jet pump being connected to the inner space for delivering fluid used as a driving medium.

4. The sealing configuration according to claim 1, including a control valve being inserted between said suction device and said vapor chamber.

5. The sealing configuration according to claim 1, including a blocking chamber being disposed between said vapor chamber and the inner space, said blocking chamber surrounding the shaft and having two sides, some of said seals being adjacent said blocking chamber on both of said sides along the axis, and an inlet conduit for delivering fluid to said seals being adjacent said blocking chamber.

6. The sealing configuration according to claim 5, wherein said inlet conduit is connected to the inner space.

7. The sealing configuration according to claim 1, including a leakage chamber being disposed between said vapor chamber and the inner space, said leakage chamber surrounding the shaft and having two sides, some of said seals being adjacent said leakage chamber on both sides along the axis, and an outlet conduit for leading fluid away from said seals being adjacent said leakage chamber.

8. The sealing configuration according to claim 7, including a leakage condenser connected to said outlet conduit.

9. In an assembly having a stationary casing, two passages for the stationary casing, a shaft leading through the passages and having an axis, and an inner space being enclosed by the stationary casing for receiving a fluid and from which the shaft emerges, a sealing configuration for the passages, comprising:

vapor chambers each surrounding the shaft, having two sides and being open to the surroundings;

seals disposed adjacent said vapor chambers on both of said sides along the axis for admitting the fluid to said vapor chambers through at least one of said seals; and a suction device connected to said vapor chambers.

10. The sealing configuration according to claim 9, including control valves each being connected upstream of said suction device and downstream of a respective one of said vapor chambers.

11. The sealing configuration according to claim 9, wherein the casing encloses a steam turbine for putting the shaft into rotation.

12. The sealing configuration according to claim 1, wherein the casing encloses a steam turbine for putting the shaft into rotation.

13. A method for operating a sealing configuration for a passage of a shaft with an axis through a stationary casing enclosing an inner space to which a fluid is admitted and from which the shaft emerges, the sealing configuration including a vapor chamber being open to the surroundings, surrounding the shaft and having two sides, seals being adjacent the vapor chamber on both of the sides along the axis for admitting the fluid to the vapor chamber through at least one of the seals, and a suction device connected to the vapor chamber, and the method comprising extracting the fluid from the vapor chamber with the suction device, except for a residual quantity of the fluid being led away to the surroundings.

14. The method according to claim 13, which comprises extracting a vapor as the fluid.

15. The method according to claim 13, which comprises extracting water vapor as the fluid.

16. The method according to claim 13, which comprises rotating the shaft.

* * * * *

UNITED STATES PATENT AND TRADEMARK OFFICE

CERTIFICATE OF CORRECTION

PATENT NO. : 5,632,492
DATED : May 27, 1997
INVENTOR(S) : Wolfgang Lehmann et al It is certified that error appears in the above-identified patent and that said Letters Patent is hereby corrected as shown below:

On the title page: Item [63] should be inserted:
Continuation of PCT/DE94/00421, April 15, 1994.

Signed and Sealed this

Sixth Day of January, 1998

*Attest:*

*Attesting Officer*

BRUCE LEHMAN

*Commissioner of Patents and Trademarks*